US011083311B2

(12) United States Patent
Cohen

(10) Patent No.: US 11,083,311 B2
(45) Date of Patent: Aug. 10, 2021

(54) CHANGING TABLE COVER

(71) Applicant: Susan L. Cohen, Norwood, NJ (US)

(72) Inventor: Susan L. Cohen, Norwood, NJ (US)

( * ) Notice: Subject to any disclaimer, the term of this patent is extended or adjusted under 35 U.S.C. 154(b) by 68 days.

(21) Appl. No.: 15/952,918

(22) Filed: Apr. 13, 2018

(65) Prior Publication Data

US 2019/0313811 A1 Oct. 17, 2019

(51) Int. Cl.

| | |
|---|---|
| ***A47D 15/00*** | (2006.01) |
| ***A45C 3/00*** | (2006.01) |
| ***A45C 13/10*** | (2006.01) |
| ***A47G 9/02*** | (2006.01) |
| ***A47G 9/10*** | (2006.01) |
| ***A47G 9/00*** | (2006.01) |

(52) U.S. Cl.

CPC ..... *A47D 15/00* (2013.01); *A45C 3/001* (2013.01); *A45C 13/103* (2013.01); *A45C 13/1046* (2013.01); *A47G 9/0246* (2013.01); *A47G 9/1045* (2013.01); *A45C 2013/1015* (2013.01); *A47G 2009/001* (2013.01)

(58) Field of Classification Search

CPC ..... A47D 15/00; A47G 9/0246; A47G 9/062; A47G 2009/001; A47C 31/10; A47C 31/105; A45C 3/001; A45C 13/1046; A45C 13/103; A45C 2013/1015; A45D 5/006; A45D 5/00

See application file for complete search history.

(56) References Cited

U.S. PATENT DOCUMENTS

| | | | | |
|---|---|---|---|---|
| 2,629,884 | A * | 2/1953 | McMonagle | A47D 15/003 5/655 |
| 4,154,323 | A * | 5/1979 | Sneider | A45C 9/00 190/2 |
| 4,566,130 | A * | 1/1986 | Coates | A45C 9/00 150/106 |
| 6,588,036 | B1 * | 7/2003 | Hort | A45F 4/06 5/413 R |
| 10,051,969 | B2 * | 8/2018 | Galloway | A47C 21/08 |
| 2004/0211003 | A1 * | 10/2004 | Stackman | A47D 5/006 5/655 |
| 2005/0081297 | A1 * | 4/2005 | Woodward | A47D 5/006 5/655 |
| 2005/0217030 | A1 * | 10/2005 | Seigler | A47C 27/003 5/738 |
| 2007/0256244 | A1 * | 11/2007 | Ashley | A47D 5/006 5/655 |
| 2008/0229506 | A1 * | 9/2008 | Saman | A47D 5/006 5/655 |
| 2009/0158525 | A1 * | 6/2009 | Paszotta | A47D 5/003 5/487 |
| 2010/0177992 | A1 * | 7/2010 | Hawbaker | A45C 7/0077 383/117 |
| 2011/0314608 | A1 * | 12/2011 | Rovin | A47D 5/006 5/655 |

(Continued)

*Primary Examiner* — Robert G Santos
*Assistant Examiner* — Alison N Labarge
(74) *Attorney, Agent, or Firm* — Robert P. Michal, Esq.; Carter, DeLuca & Farrell LLP

(57) ABSTRACT

A changing table cover comprises a sheet, a pillow and a bag. The sheet includes a plurality of corner portions, at least two of which include elastic material. The pillow is affixed to a top surface of the sheet. The bag is affixed to an end portion of the sheet.

20 Claims, 3 Drawing Sheets

(56) References Cited

U.S. PATENT DOCUMENTS

| | | | | |
|---|---|---|---|---|
| 2012/0317722 | A1* | 12/2012 | Pary | A47D 5/003<br>5/485 |
| 2015/0313374 | A1* | 11/2015 | Johnson | A47D 15/006<br>428/12 |
| 2016/0257479 | A1* | 9/2016 | Seiders | B65D 81/389 |
| 2016/0262557 | A1* | 9/2016 | Williams | A47G 9/0246 |
| 2017/0303652 | A1* | 10/2017 | Tate | A45C 9/00 |

* cited by examiner

CHANGING TABLE COVER

BACKGROUND

The present disclosure relates to covers for changing tables, such as the baby changing tables typically found in public restrooms. According to various studies, changing tables found in public restrooms are often unsanitary. Given the susceptibility of young children to infection, illness, and the like, there is a need for a means of enabling children to have their diapers changed upon changing tables in a safe manner that minimizes their chances of contracting an infection, illness, disease or the like therefrom.

SUMMARY

To the extent consistent, any of the aspects and features detailed herein may be utilized with any of the other aspects and features detailed herein.

Provided in accordance with aspects of the present disclosure is a changing table cover. The changing table cover includes a sheet, a pillow and a bag. The sheet includes a plurality of corner portions, at least two of which include elastic material. The pillow is affixed to a top surface of the sheet. The bag is affixed to an end portion of the sheet.

In an aspect of the present disclosure, at least one of the sheet, the pillow, or the bag is formed of sanitary material.

In another aspect of the present disclosure, the sanitary material includes bamboo.

In still another aspect of the present disclosure, at least one of the sheet, the pillow, or the bag is formed of washable material.

In still yet another aspect of the present disclosure, the bag has an opening that is closeable.

In yet another aspect of the present disclosure, the bag includes a cord that can be manipulated to open and close the opening of the bag.

In an aspect of the present disclosure, the bag includes a zipper that can be manipulated to open and close the opening of the bag.

In another aspect of the present disclosure, the bag includes a hook and loop fastener that can be manipulated to open and close the opening of the bag.

In still another aspect of the present disclosure, the bag includes a mechanism that can be manipulated to open and close the opening of the bag, and when the opening is closed, the mechanism prevents the exchange of at least one of liquid or gas between an inner portion of the bag and an outer portion of the bag.

In yet another aspect of the present disclosure, the pillow is removably affixed to the sheet.

In still yet another aspect of the present disclosure, the pillow is removably affixed to the sheet by way of a hook and loop fastener.

In an aspect of the present disclosure, at least one lengthwise dimension of the sheet is sized to fit a lengthwise dimension of a changing table platform.

In another aspect of the present disclosure, the two corner portions including elastic material are configured to fit around two corners, respectively, of the changing table platform.

In still another aspect of the present disclosure, the two corners including the elastic material are positioned adjacent to one another.

In yet another aspect of the present disclosure, the pillow is sewn between two layers of the sheet.

In still yet another aspect of the present disclosure, the bag is detachably affixed to the end portion of the sheet.

In an aspect of the present disclosure, the bag is non-detachably affixed to the end portion of the sheet.

In another aspect of the present disclosure, the changing table cover further includes a non-slip material affixed to a bottom portion of the sheet.

In still another aspect of the present disclosure, the sheet is configured to fold up into an opening of the bag.

In still yet another aspect of the present disclosure, the pillow is sized to fit in the opening of the bag along with the sheet.

BRIEF DESCRIPTION OF THE DRAWINGS

Aspects and features of the present disclosure are described hereinbelow with reference to the drawings, wherein.

DETAILED DESCRIPTION

Detailed embodiments of the present disclosure are disclosed herein; however, the disclosed embodiments are merely examples of the disclosure, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

The embodiments herein describe a changing table cover that overcomes various shortcomings of other baby changing solutions. Changing pads that are typically provided with diaper bags are not large enough to cover a standard changing table. If such a changing pad were used on a platform of a changing table, the baby's body parts come in contact with a filthy surface. The changing table cover described herein addresses this shortcoming by being sized large enough to fit the changing table platform and by including various means, such as fitted corners, non-slip components, and/or the like, of securing the changing table cover to the platform despite any movements the baby may make. In addition, changing pads typically provided with diaper bags are not provided with a means of protecting other items that may be within the diaper bag. Germs and bacteria can therefore easily be transferred to items inside of the diaper bag. The changing table cover described herein addresses this shortcoming by including a bag portion in which the remaining parts of the changing table cover can be stored when not in use, thereby keeping germs within the bag portion and isolated from other items with which the bag portion may come in contact. The changing table cover described herein can also be used anywhere, not only public restrooms, and is compact enough to easily fit within a diaper bag and most purses for portability.

Figure 1:
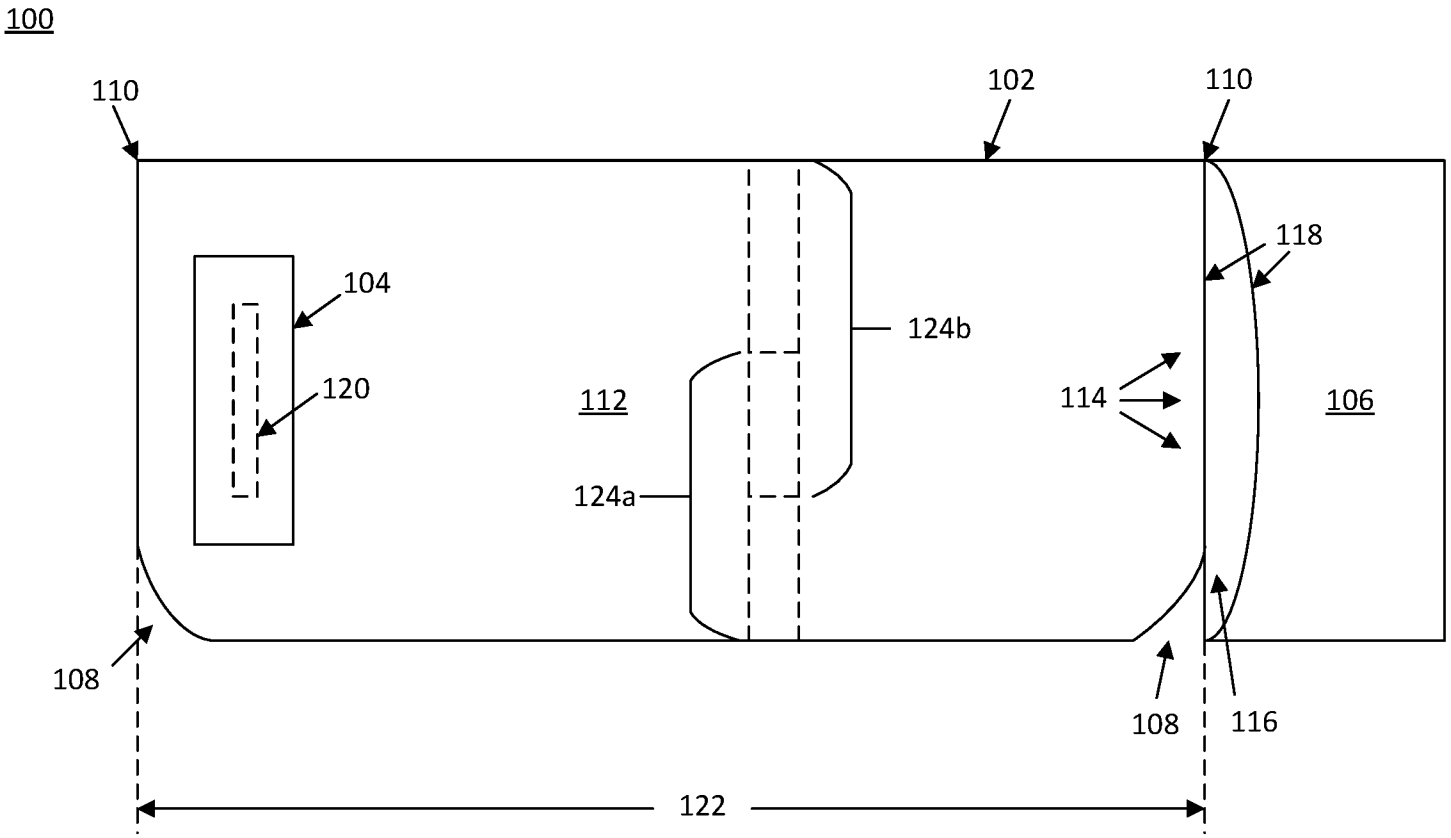
FIG. 1 is a top view of a changing table cover provided in accordance with the present disclosure.

FIG. 1 is a top view of a changing table cover 100 provided in accordance with the present disclosure. The changing table cover 100 includes a sheet portion 102 (referred to herein as a sheet), a pillow portion 104 (referring to herein as a pillow), and a bag portion 106 (referred to herein as a bag). The sheet 100 includes a plurality of corner portions 108, 110, at least two of which (108) include elastic material. The pillow 104 is affixed to a top surface 112 of the sheet 102. The bag 106 is affixed to an end portion 114 of the sheet 102.

In an aspect of the present disclosure, various portions of the changing table cover 100, such as the sheet 102, the pillow 104, and/or the bag 106, are formed of one or more types of sanitary, antimicrobial, and/or washable material or fabric. In some examples, the entire changing table cover 100 is formed of sanitary and/or a naturally disinfectant material. Example types of sanitary or antimicrobial material from which various portions of the changing table cover 100 may be formed include, without limitation, vinyl, rubber, bamboo, Zorb®, and/or the like.

In some aspects, various portions of the changing table cover 100, such as the sheet 102, the pillow 104, and/or the bag 106, are formed of one or more types of washable, non-toxic, and/or comfortable material. In some examples, the entire changing table cover 100 is formed of material that is washable, such as via an electromechanical washing machine. Example types of washable material from which various portions of the changing table cover 100 may be formed include, without limitation, vinyl, rubber, bamboo, Zorb®, and/or the like.

The bag 106, in some example aspects, has an opening 116 that is closeable. In yet another aspect of the present disclosure, the bag 106 includes a mechanism 118, such as a cord, a zipper, a hook and loop fastener, a drawstring, or any other suitable fastening mechanism, that can be manipulated to open and close the opening 116 of the bag 106. The mechanism 118 may be manipulable to open and close the opening 116 of the bag 106 such that, when the opening 116 is closed, the mechanism 118 prevents the exchange of solids, liquids, and/or gases, such as unsanitary germs, bacteria, or other material which may have been picked up from the platform 202, between an inner portion of the bag 106 and an outer portion of the bag 106.

The pillow 104, in some embodiments, is removably affixed to the top surface 112 of the sheet 102 by way of any suitable fastening mechanism 120, such as a hook and loop fastener (e.g., a Velcro® strap) and/or the like. Alternatively, the pillow 104 is non-removably affixed to the sheet 102, for instance, by being sewn between two layers of the sheet 102. In some embodiments, the pillow 104 is located substantially in the middle of the top surface 112 in a direction perpendicular to the wall (not shown in FIG. 2) when the cover 100 is arranged on the platform 202 as shown in FIG. 2.

The bag 106 may, in some aspects, be detachably affixed to the end portion 114 of the sheet 102. Alternatively, the bag may be non-detachably affixed to the end portion 114 of the sheet 102.

Figure 2:
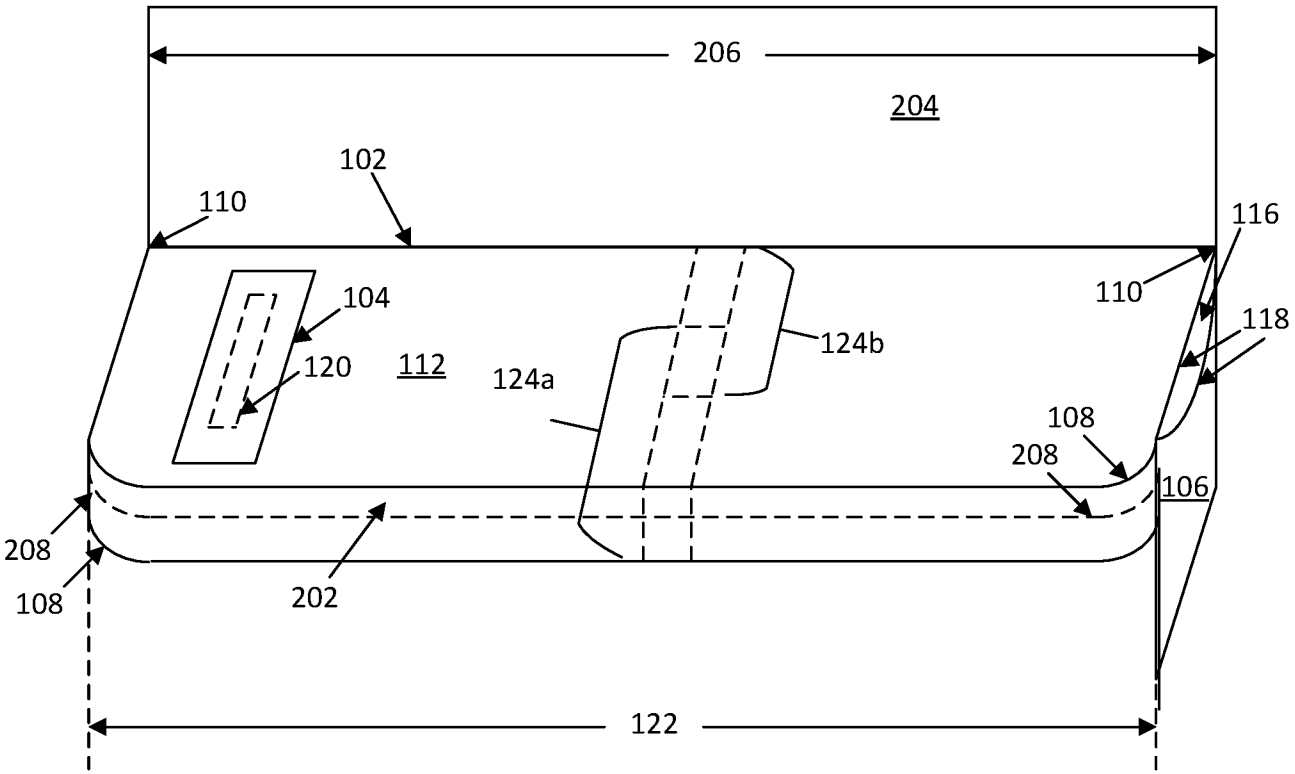
FIG. 2 is a front, perspective view of the changing table cover of FIG. 1, placed upon a changing table.
Figure 3:
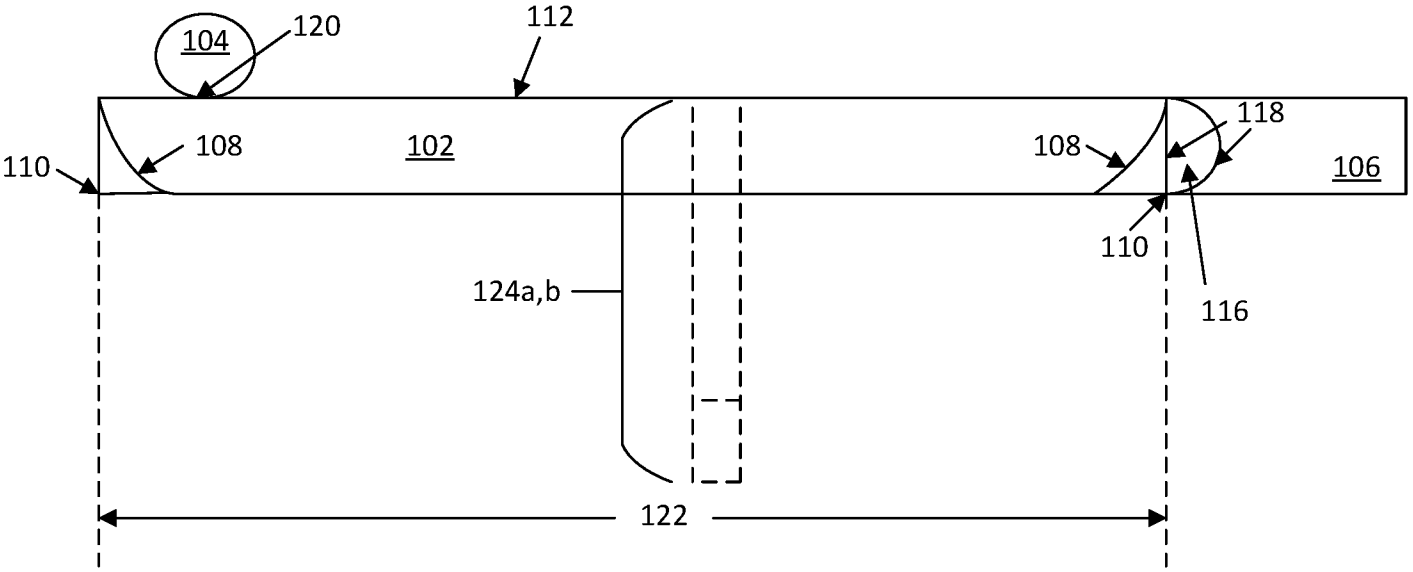
FIG. 3 is a side view of the changing table cover of FIG. 1.

FIG. 2 is a front, perspective view of the changing table cover 100 of FIG. 1, placed upon a platform 202 of a changing table 200 that also includes a wall mounted portion 204, and FIG. 3 is a side view of the changing table cover 100 of FIG. 1. In some embodiments, the changing table cover 100 is sized to fit the changing table platform 202. For example, at least one lengthwise dimension, such as, a dimension 122 from an end of the sheet 102 near the pillow 104 to an end of the sheet 102 near the bag 106, may be sized to fit a lengthwise dimension 206 of the changing table platform 202. As shown in both FIG. 2 and FIG. 3, when the sheet 102 is placed upon the platform 202, the bag 106 is configured to be suspended from the platform 202 near the end portion 114 of the sheet 102, in a manner so as not to contact the platform 202 (for example, to prevent germs from being transferred from the platform 202 to the bag 106) and so as to avoid interfering with a baby during use of the changing table cover 100. In some examples, the sheet 102 has dimensions of 35 inches long (in a direction parallel to the wall, for instance), 20 inches deep (in a direction perpendicular to the wall, for instance), and 4 inches high (in a direction from the floor to the ceiling, for instance). In this manner, for example, unlike some changing pads that are undersized, the changing table cover 100 of the present disclosure may provide full coverage over the changing table platform 202, maximizing protection from germs and the like which may be present on the changing table platform 202.

In another aspect, the two corner portions 108 that include elastic material may be sized or otherwise configured to fit around two corners 208, respectively, of the changing table platform 202. The two corners 108 that include the elastic material may, in various embodiments, be positioned adjacent to one another, for example, so as to fit around the two corners 208 of the changing table platform 202 furthest from the wall mounted portion 204. The corners 110 may exclude elastic portions, so that those corners 110 may abut the wall mounted portion 204.

In some examples, the changing table cover 100 includes a non-slip material, such as tacky rubber, affixed to a bottom portion of the sheet 102. Alternatively, or in addition, the changing table cover 100 may include two or more straps 124*a* and 124*b* affixed to two or more opposing sides of the changing table cover 100 that can overlap, and be adhered to, one another beneath the platform 202 (for example, by way of a hook and loop fastener such as Velcro®) to secure the changing table cover 100 in place during use. In this manner, the changing table cover 100 may be kept in place upon the changing table platform 202 despite a baby shifting its position on the top surface 112 of the changing table cover 100.

The sheet 102 may be configured to fold up into the opening 116 of the bag 106. The pillow 104 may also be sized to fit in the opening 116 of the bag 106 along with the sheet 102. In this manner, any germs, bacteria, or the like that may have been introduced to the sheet 102 and/or the pillow 104 (for example, from coming into contact with the changing table platform) may be contained within the bag 106 and prevented from spreading or coming in contact with people or other items, such as the interior of a diaper bag, a purse, or the like.

As can be appreciated in view of the forgoing, the changing table cover of the present disclosure enables children to have their diapers changed upon changing tables in a safe manner that minimizes their chances of contracting an infection, illness, disease or the like therefrom, despite the unsanitary condition of many publicly available changing tables.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A changing table cover, comprising:

a sheet including at least four corner portions, wherein two of the at least four corner portions along a length side of the sheet include elastic material, are positioned adjacent to one another, and have a rounded shape, and the other portions of the at least four corner portions along the other length side of the sheet exclude the elastic material and are positioned adjacent to one another and have a substantially right-angled shape, wherein the length side is longer than a width side of the sheet;

at least two fasteners affixed to both sides of the length side and configured to fasten the changing table cover to a changing table platform when in use by fastening the at least two fasteners;

a pillow affixed to a top surface of the sheet; and a bag affixed to an end portion of the sheet.

2. The changing table cover of claim 1, wherein at least one of the sheet, the pillow, or the bag is formed of sanitary material.

3. The changing table cover of claim 2, wherein the sanitary material includes at least one of bamboo or an antimicrobial fabric.

4. The changing table cover of claim 1, wherein at least one of the sheet, the pillow, or the bag is formed of washable material.

5. The changing table cover of claim 1, wherein the bag has an opening that is closeable.

6. The changing table cover of claim 5, wherein the bag includes a cord that can be manipulated to open and close the opening of the bag.

7. The changing table cover of claim 5, wherein the bag includes a zipper that can be manipulated to open and close the opening of the bag.

8. The changing table cover of claim 5, wherein the bag includes a hook and loop fastener that can be manipulated to open and close the opening of the bag.

9. The changing table cover of claim 5, wherein the bag includes a mechanism that can be manipulated to open and close the opening of the bag, wherein when the opening is closed, the mechanism prevents the exchange of at least one of a liquid or a gas between an inner portion of the bag and an outer portion of the bag.

10. The changing table cover of claim 9, wherein the pillow is removably affixed to the sheet by way of a hook and loop fastener.

11. The changing table cover of claim 1, wherein the pillow is removably affixed to the sheet.

12. The changing table cover of claim 1, wherein at least one lengthwise dimension of the sheet is sized to fit a lengthwise dimension of the changing table platform.

13. The changing table cover of claim 12, wherein the two corner portions including the elastic material are configured to fit around two corners, respectively, of the changing table platform.

14. The changing table cover of claim 1, wherein the bag is detachably affixed to the end portion of the sheet.

15. The changing table cover of claim 1, wherein the bag is non-detachably affixed to the end portion of the sheet.

16. The changing table cover of claim 1, further comprising a non-slip material affixed to a bottom portion of the sheet.

17. The changing table cover of claim 1, wherein the sheet is configured to fold up into an opening of the bag.

18. The changing table cover of claim 17, wherein the pillow is sized to fit in the opening of the bag along with the sheet.

19. The changing table cover of claim 1, wherein the at least two fasteners are fastened under the changing table platform.

20. The changing table cover of claim 1, wherein the changing table cover provides full coverage over the changing table platform.

* * * * *